US009488419B2

(12) United States Patent
Wanni

(10) Patent No.: US 9,488,419 B2
(45) Date of Patent: Nov. 8, 2016

(54) TUBE SUPPORT FOR VIBRATION MITIGATION

(71) Applicant: Amar Siri Wanni, Fairfax, VA (US)

(72) Inventor: Amar Siri Wanni, Fairfax, VA (US)

( * ) Notice: Subject to any disclaimer, the term of this patent is extended or adjusted under 35 U.S.C. 154(b) by 26 days.

(21) Appl. No.: 14/077,330

(22) Filed: Nov. 12, 2013

(65) Prior Publication Data

US 2015/0129166 A1 May 14, 2015

(51) Int. Cl.
*F28F 9/013* (2006.01)
*F28D 7/06* (2006.01)

(52) U.S. Cl.
CPC ..... *F28F 9/013* (2013.01); *F28D 7/06* (2013.01); *F28F 9/0132* (2013.01)

(58) Field of Classification Search
CPC ..... F28F 9/0132
USPC ..... 165/69, 162
See application file for complete search history.

(56) References Cited

U.S. PATENT DOCUMENTS

| | | | | |
|---|---|---|---|---|
| 3,545,534 | A * | 12/1970 | Coles | 165/67 |
| 3,637,008 | A * | 1/1972 | Michel et al. | 165/69 |
| 4,648,442 | A * | 3/1987 | Williams | 165/162 |
| 4,747,373 | A * | 5/1988 | Wepfer et al. | 122/510 |
| 4,919,199 | A * | 4/1990 | Hahn | 165/162 |
| 4,991,645 | A * | 2/1991 | Lagally et al. | 165/69 |
| 5,213,155 | A * | 5/1993 | Hahn | 165/162 |
| 6,401,803 | B1 * | 6/2002 | Hahn | 165/69 |
| 6,772,832 | B2 * | 8/2004 | Schneider | 165/162 |
| 7,032,655 | B2 | 4/2006 | Wanni et al. | |
| 7,128,130 | B2 | 10/2006 | Wanni et al. | |
| 7,267,164 | B2 | 9/2007 | Wanni et al. | |
| 7,506,684 | B2 | 3/2009 | Wanni et al. | |
| 7,793,708 | B2 | 9/2010 | Wanni et al. | |
| 2003/0196786 | A1 * | 10/2003 | Schneider | 165/162 |
| 2011/0253341 | A1 * | 10/2011 | Al-Otaibi et al. | 165/69 |

* cited by examiner

*Primary Examiner* — Allen Flanigan
(74) *Attorney, Agent, or Firm* — Louis Ventre, Jr.

(57) ABSTRACT

A tube support in the form of a stake having at least one protrusion mounted on its longitudinal surface. The protrusion contacts adjoining tubes of a tube bundle and exerts a force tending to separate the tubes.

3 Claims, 12 Drawing Sheets

TUBE SUPPORT FOR VIBRATION MITIGATION

FIELD OF THE INVENTION

This invention relates to tube support devices, which are also called tube stakes that are inserted into tube bundles in heat exchangers and other fluid-handling equipment.

BACKGROUND OF THE INVENTION

Heat exchangers and other fluid-handling equipment are often fitted with tube bundles that are fabricated by the attachment of a collection of tubes to one or two tubesheets. The tubes in the bundle may be arranged in two primary layouts: rectangular (also referred to as inline arrangement) and triangular (also referred to as staggered arrangement). The rectangular arrangement leads to tubes that are aligned vertically and horizontally while the triangular arrangement sets three adjacent tubes at the vertices of an equilateral triangle.

The tube bundle may be fitted with a series of baffles that provides support to the tubes while also diverting the shellside flow across the tube bundle in a serpentine manner. The firm attachment of tubes to the tubesheets enables the use of two separate fluids: one on the shellside and the second on the tubeside. Such an exchanger, therefore, allows energy transfer across the tube wall thickness from one fluid to the other.

The shellside fluid, for the most part, flows orthogonal to the tubes in the bundle. Such a crosswise flow tends to create unstable eddies on the downstream side of some or all tubes. Under some conditions, such eddies may lead to vibration of the tubes. Depending on the intensity of these vibrations, some tubes may experience excessive displacements from their original (i.e., with no flow condition) locations and eventually lead to tube failures.

Tube damage owing to flow-induced vibration can occur very quickly (several days or weeks) or take several years. Also, a properly designed exchanger may experience such failures owing to a recent increase in shellside flow rate, the flow conditions, tube wall corrosion, etc. Tube failures often require isolation of the exchanger for repair thereby causing costly downtime (e.g., production losses) and the associated repair costs as well as operational risks.

In their U.S. Pat. Nos. 7,032,655, 7,128,130, and 7,267,164, Wanni, et al. provide background on the state-of-the-art tube support devices available on the marketplace for vibration mitigation in tube bundles. Those patents are incorporated by reference here for their disclosures where necessary to provide background to the present invention.

Such prior art also discuss in detail the weaknesses of those technologies available in the marketplace. While the technologies presented by Wanni, et al. solve most of the problems they had described, the new technologies proposed by Wanni, et al. also have several limitations.

First, the dimples located on one end of the tube support as well as the protrusions along the remaining length require substantial amount of metal deforming (starting from a flat thin strip of metal), especially, for the rectangular tube arrangement which has the widest tube lanes. As a result, proper forming of dimples would be difficult for harder metallurgies, such as Titanium and Duplex Steel, where penetrating cracks are difficult to avoid.

Second, fabrication of tube support requires a very high pressing force (in excess of 200 tons representing expensive machinery), especially, when a single pressing operation is used. The use of multiple pressings along the length of the tube support decreases the required pressing force, but this lowers the technical quality of the stake and also increases the production time substantially.

Third, fabrication of these tube supports requires the use of high-precision die sets that are very expensive and they will wear out and can be damaged with repeated use.

Fourth, these tube supports cannot properly support those tubes that are located very close to the shell inner diameter when U-tube bundles are involved; this is because some of the tubes can be located only ⅛" (3.2 mm) away from the shell inner diameter, but the dimples have a thickness of ⅜" (9.5 mm) in this region.

Fifth, the dimples at the outer end of the tube support do not provide an adequately robust locking with the nearby tubes so that the stake can pivot around this outer end and rotate under some conditions, especially when the tube support has a somewhat loose fit within the tube bundle.

Sixth, the equipment used for the purpose of fabricating the tube supports with the dimples and protrusions does not lend itself easily to achieve an adjustable overall thickness for the tube support.

Seventh, once the tube support is formed, its overall thickness, that determines the extent of vibration mitigation, cannot be adjusted in any way. This could lead to inadequate tube support in certain regions of a tube bundle or additional tube support must be used to achieve an acceptable level of vibration mitigation.

In their U.S. Pat. Nos. 7,506,684 and 7,793,708, Wanni, et al. provide an alternate stake design that is limited only to tube bundles having the rectangular tube arrangement.

SUMMARY OF THE INVENTION

In a basic form the present invention is directed to a tube support device for a tube bundle that has a plurality of elongated, longitudinally extending tubes arranged in rows, with tube lanes extending substantially perpendicularly to the tube rows and separating adjacent rows of tubes. The support device takes the form of an elongated, longitudinally extending tube stake inserted in one of the tube lanes.

The tube stake that is essential to my invention has at least one protrusion formed along its length, the protrusion having a forward end and a rearward end. The elongated stake is inserted in a tube lane so that a first tube is located at the forward end of the protrusion and a second, next adjacent tube of the bundle is positioned at the rearward end of the protrusion. The protrusion is sized so that, in tube contacting position, it exerts a force on the tubes that at least has a component that is substantially parallel to the longitudinal axis of the stake, so that the opposed faces move the contacted tubes away from each other and stress the tubes. In this manner the tubes are made more rigid and their vibration during the flow of fluid across them is reduced.

The support device, or tube stake, is the subject of the invention, as is the combination of the tube stake and the tube bundle. The tube stake can be formed from a single strip of material, usually metal, or two strips of metal joined along their primary surfaces in back-to-back position. The protrusions can be pressed from a single strip of metal or welded or otherwise affixed to the surface of the tube stake.

Whether the stake is a single or double strip, one or more protrusions can be formed on one or opposed surfaces of the stake and, if there are protrusions on opposed surfaces, the protrusions can be aligned in back-to-back position or, more advantageously, spaced alternately along opposed surfaces of the supporting device.

DRAWINGS

DETAILED DESCRIPTION OF PREFERRED EMBODIMENT

The tube support or stake device of the present invention provides direct and robust support to the tubes on both sides flanking the stake. In its preferred embodiment the stake has an effective thickness that is greater than the spacing between the tubes to account for the clearance between the tubes and the holes in the baffles as well as to account for the slight warping of the tubes.

The length of the stake may be selected to satisfy the number of tubes requiring such support based on the estimated vibration damage potential. In fact, in some regions, such support may be needed across the entire tube bundle while some other regions may require support only to a depth of several tube rows. If necessary, the stake may extend across the entire bundle cross-section, but insertion of the stake would be somewhat easier if the stake length is limited to a maximum equal to the bundle radius.

Since the stake deflects all of the tubes that it comes in contact with, for the most part stakes are inserted only in alternate tube lanes; however, if additional tube support is deemed necessary, on a rare basis, stakes may be inserted in adjacent tube lanes as well.

Figure 1:
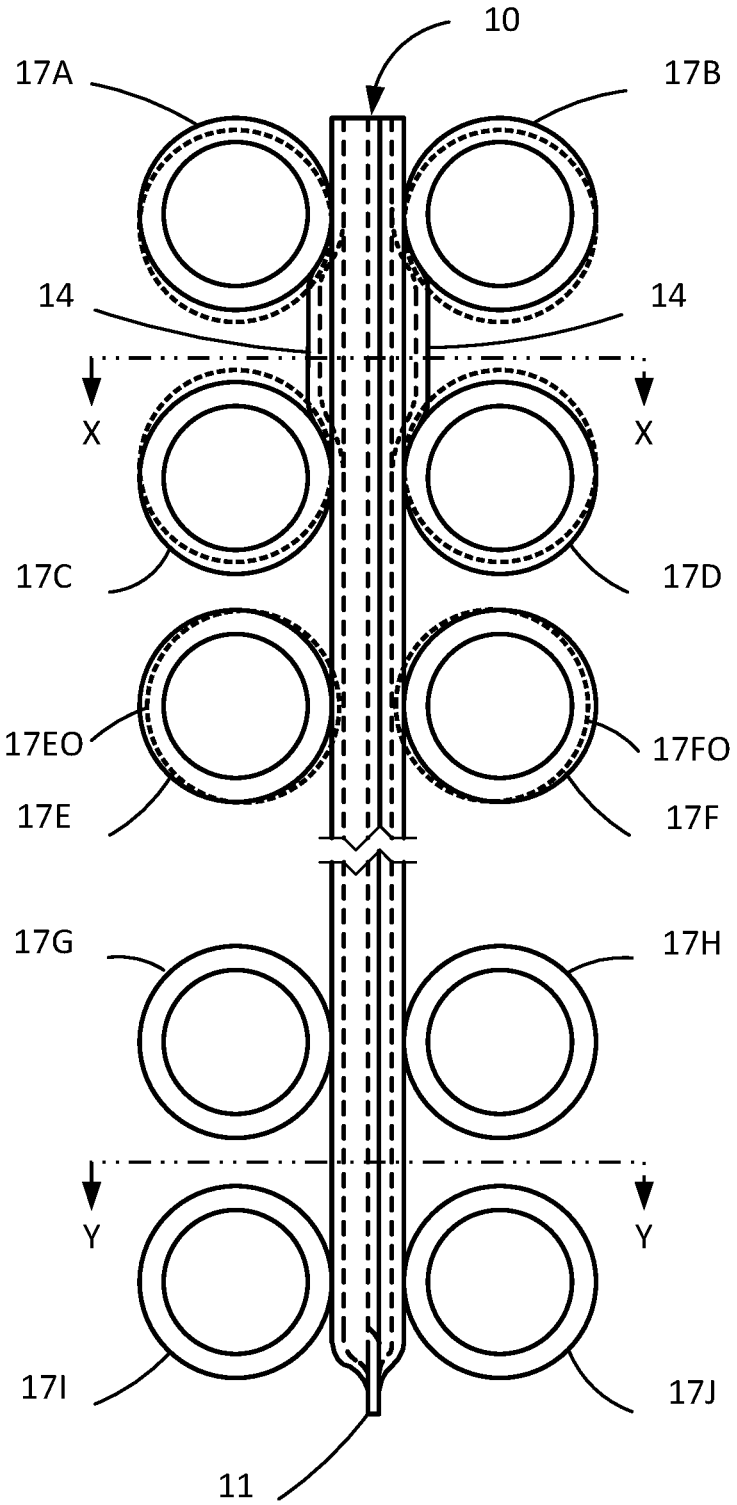
FIG. 1 is a view of set of tubes in rectangular arrangement with a tube stake according to the present invention supporting the tubes.

FIG. 1 shows ten tubes in a rectangular arrangement. A tube stake 10 consisting of a formed strip is inserted in the tube lane between the two vertical columns of tubes 17A-J. Stake 10 shows protrusions 14 pressed into the strip.

Figure 2:
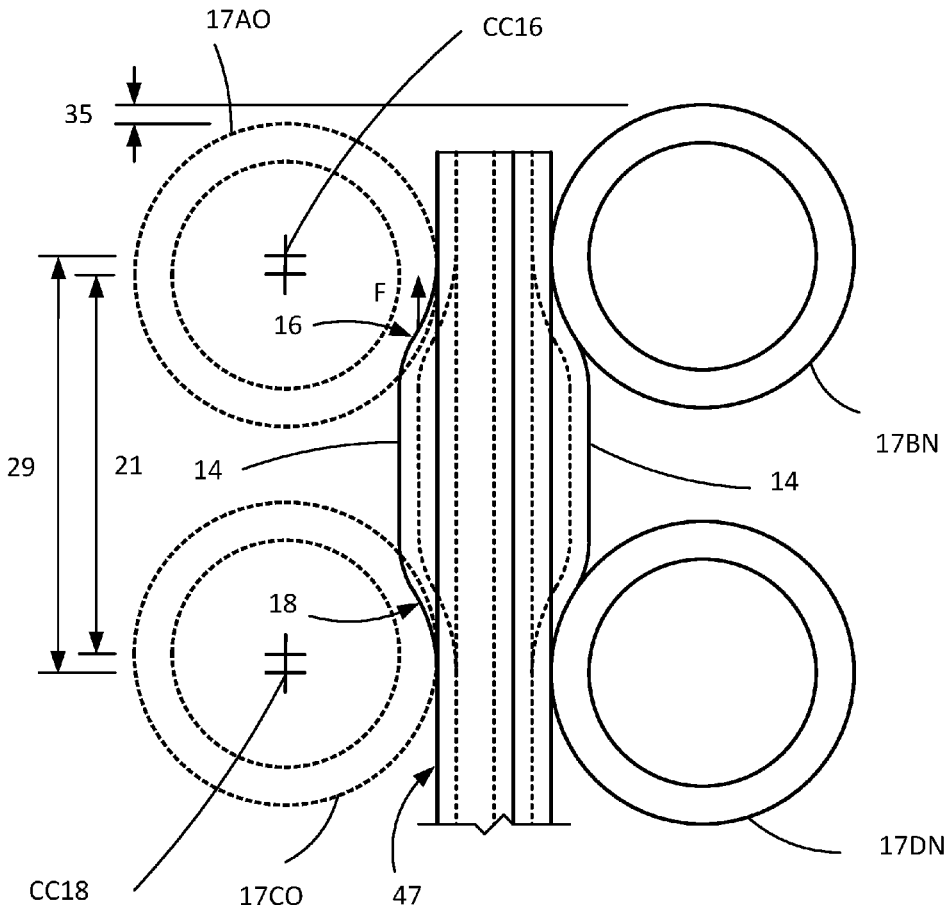
FIG. 2 is an enlarged view of four tubes and a portion of tube stake shown in FIG. 1.

These protrusions 14 have a forward surface 16 and a rearward surface 18, as shown in FIG. 2. The forward surface 16 and rearward surface 18 are sized to move the tubes in a plane parallel to the axis of the stake.

Referring to FIG. 2, stake 10, at the base 47 of protrusions 14, has a thickness that is greater than the spacing between tubes; therefore, when stake 10 is inserted, all of tubes 17A-J would be deflected away from Stake 10. FIG. 2 also shows the original tube-to-tube central distance commonly known in industry as tube pitch 21. FIG. 1 shows these deflections of tubes as depicted with just two tubes 17E and 17F, as an example; to reduce clutter, only tubes 17E and 17F are shown with their original positions of 17EO and 17FO, respectively. In addition, a forward center of curvature CC16 of forward surface 16 and a rearward center of curvature CC18 of rearward surface 18 are also shown in FIG. 2.

Also, the distance between forward center of curvature CC16 and rearward center of curvature CC18 represents altered tube pitch 29. The difference between tube pitch 21 and altered tube pitch 29 is indeed exactly twice the relative displacement 35 between Tubes 17A and 17C as seen in FIG. 2 once stake 10 is inserted into the tube bundle.

The presence of protrusions 14 in the stake pushes tubes 17A and 17B upwards, resulting in a force "F" as shown in FIG. 2, while tubes 17C and 17D are pushed downward. The original locations of tubes 17A and 17C are represented by tubes 17AO, 17CO as shown in the dashed circles in FIG. 2. For Tubes 17B and 17D shown in FIG. 1, the new locations are shown in the dark circles and are labeled as tubes 17BN and 17DN as shown in FIG. 2.

Figure 3:
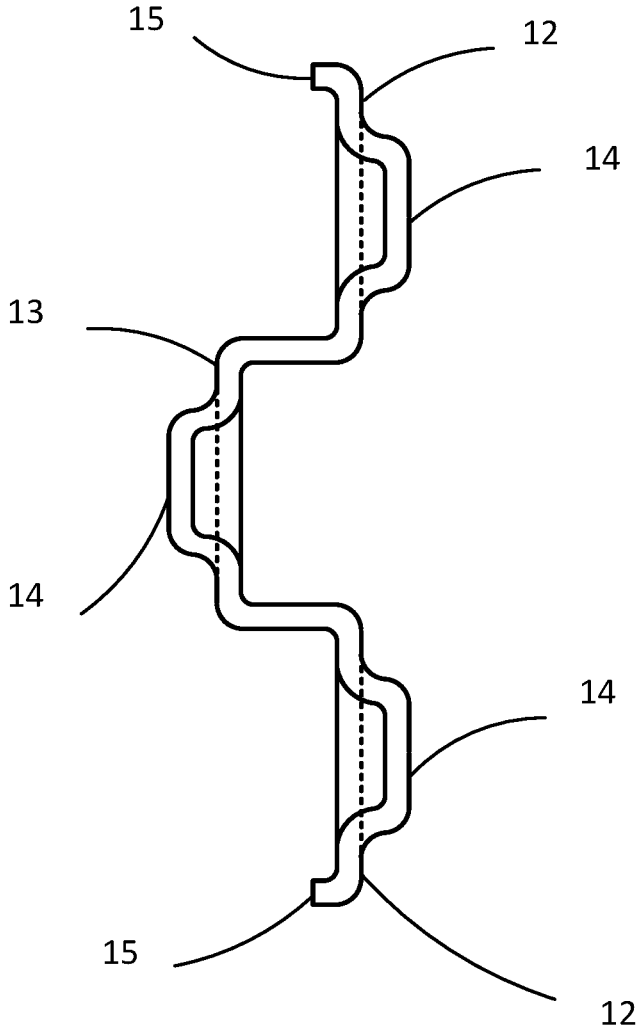
FIG. 3 is a section in the direction of the arrows X-X of FIG. 1 showing details of the protrusions in the stake.
Figure 4:
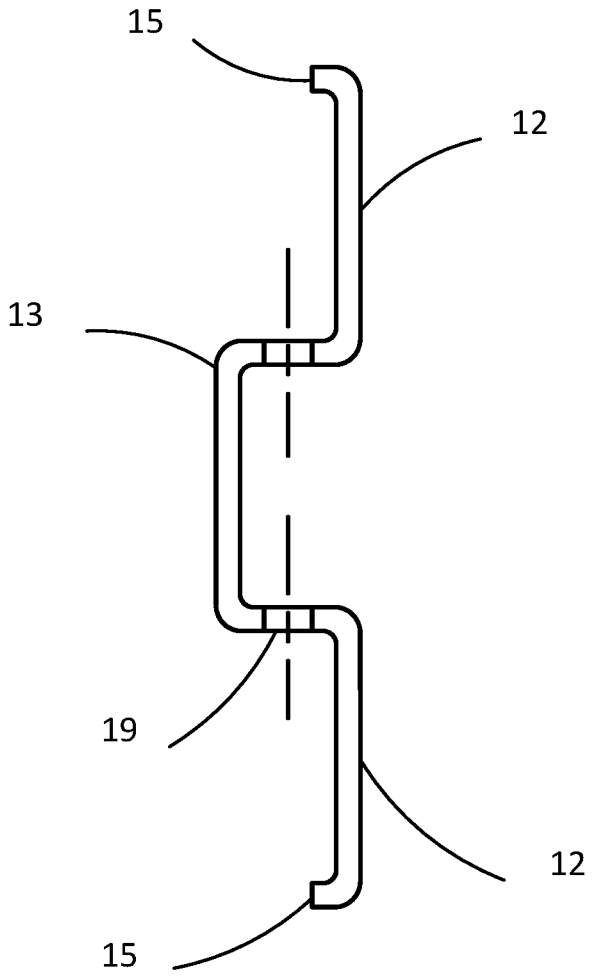
FIG. 4 is a section in the direction of the arrows Y-Y of FIG. 1.

FIG. 3 shows the cross-sectional details of stake 10 as section X-X in FIG. 1. It shows two first flat areas 12 and one second flat area 13 that provide seating against tubes 17 as seen in FIG. 1. Each of these flat areas (two first flat areas 12 and second flat area 13) contain the protrusions 14. Folded ends 15 provide additional rigidity to the stake 10 while also avoiding potential tube damage that could otherwise occur by the presence of any sharp edges. FIG. 4 shows the cross-sectional details of the stake 10 in the remaining length without the protrusions 14. FIG. 4 also shows that perforations 19 may be provided on the stake to minimize the pressure drop on the fluid that flows across the tubes.

Figure 5:
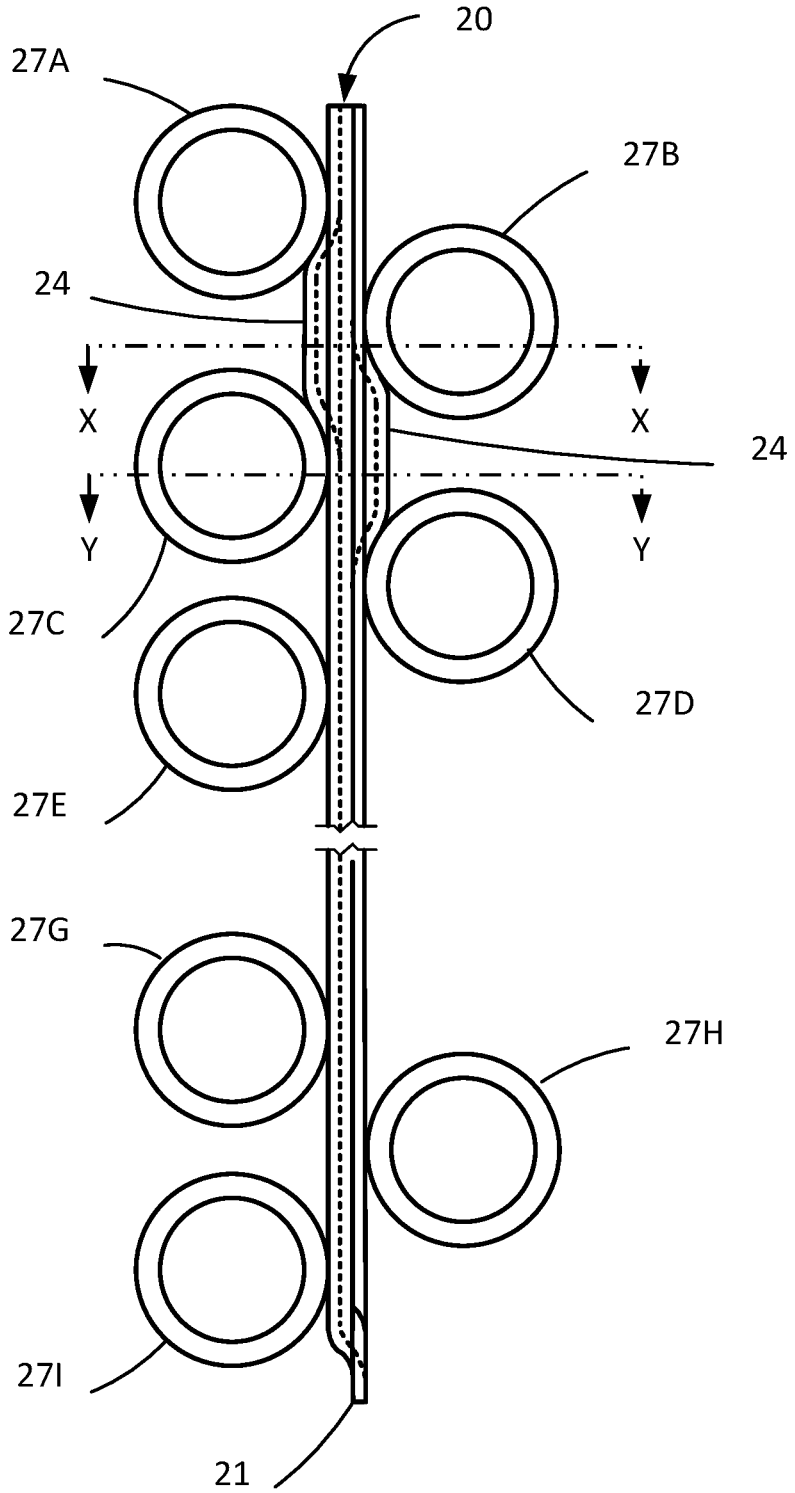
FIG. 5 is a view of set of tubes in triangular arrangement with a tube stake according to the present invention supporting the tubes.

FIG. 5 shows part of a tube bundle with eight tubes in a triangular arrangement. Generally, tube 27B and tube 27C will be placed on a horizontal plane so that the stake 20 would be inclined 60 degrees from the horizontal direction. The particular arrangement shown in FIG. 5 was selected for convenience in preparing the drawing. For this triangular tube arrangement, owing to the reduced tube lane thickness, stake 20 would be substantially thinner than stake 10 shown in FIG. 1. A first flat surface 23, shown in FIG. 6 for clarity, provides support to tubes 27A-C-E-G-I in FIG. 5 located on the left side of stake 20, while second flat surfaces 22, also shown in FIG. 6, provide support to tubes 27B-D-H located on the right side of stake 20.

Figure 6:
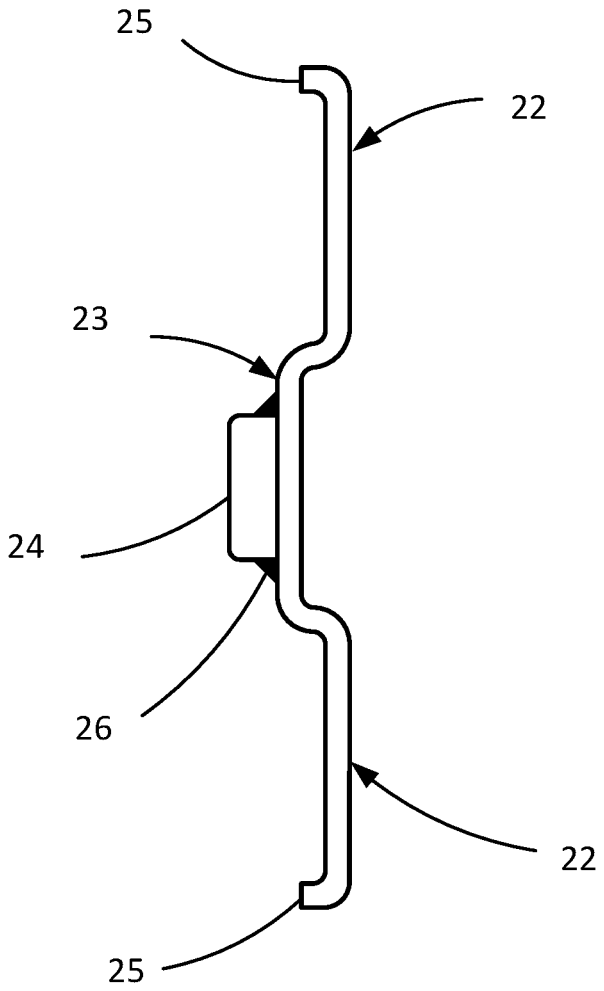
FIG. 6 is a section in the direction of the arrows X-X of FIG. 5 showing details of the protrusions in the stake.

FIG. 6 shows the cross-section of stake 20 revealing a welded protrusion 24 representing a welded metal piece.

Figure 7:
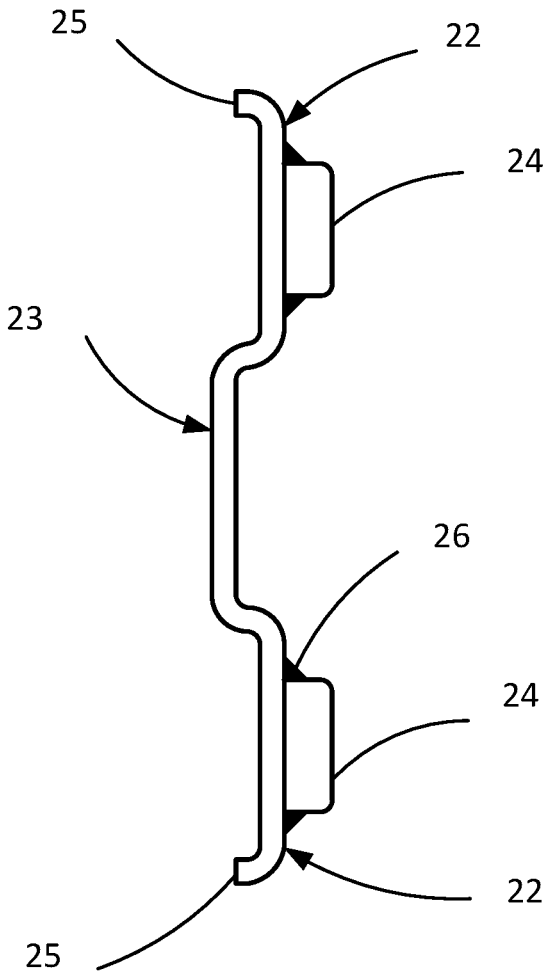
FIG. 7 is a section in the direction of the arrows Y-Y of FIG. 5 showing details of the protrusions in the stake.

FIG. 7 shows the cross-sectional detail of stake 20 revealing a welded protrusion 24 at two locations, both welded protrusions appear on the flat surfaces (first flat surface 23 and second flat surfaces 22). Once again, end portions 25 are provided to improve strength of stake as well as to avoid tube damage owing to the presence of sharp edges that may occur otherwise.

Figure 8:
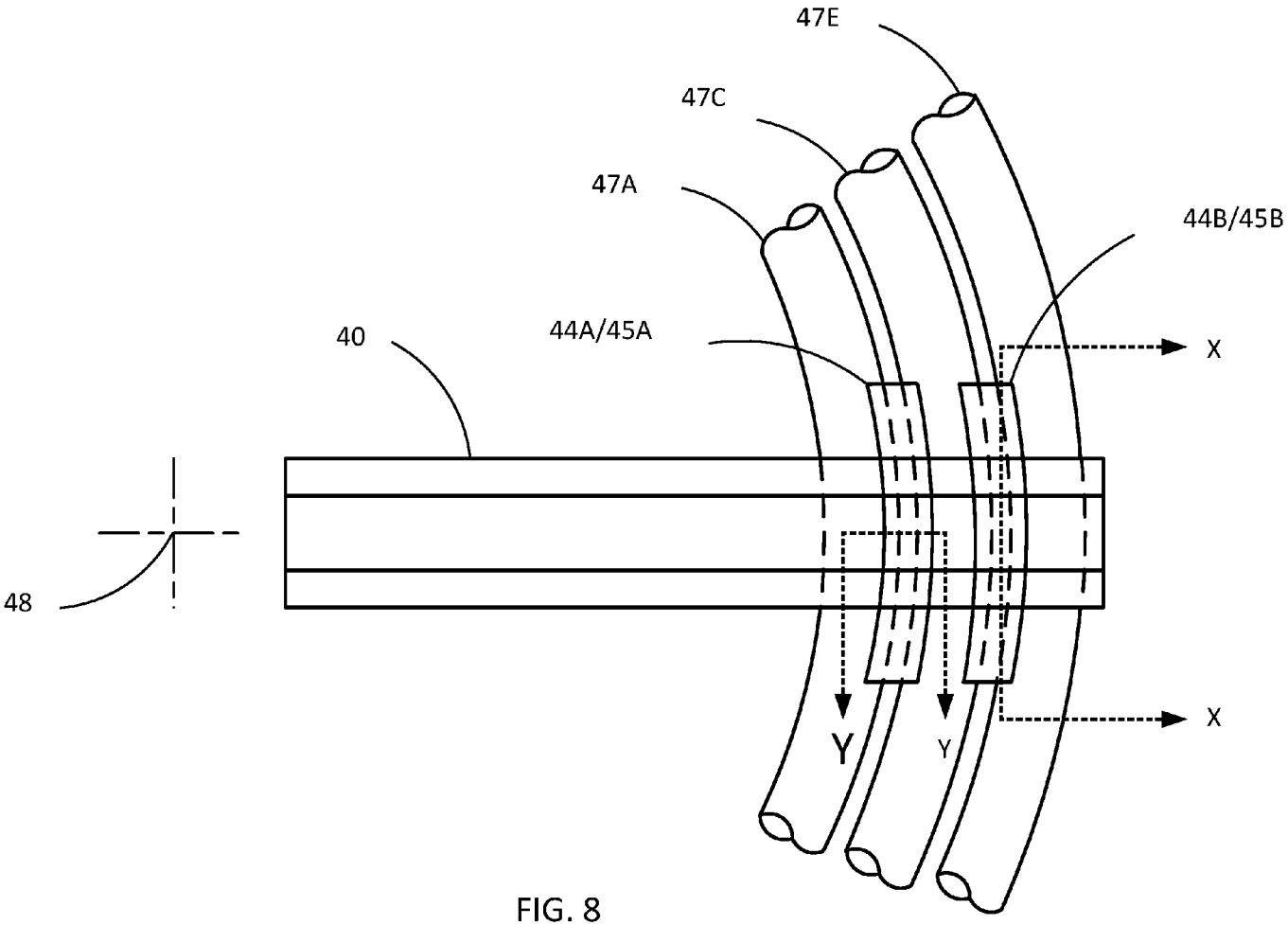
FIG. 8 is a front view of several tubes in the U-bend region with a stake supporting the tubes.

FIG. 8 shows a stake 40 inserted into the U-bend region of a U-tube bundle. The stake 40 does not need to reach the center 48 of the U-bend as the inner tube rows have much smaller U-bend radii compared to the outer tubes; a smaller U-bend radius increases the stiffness of the tubes so that the stake 40 does not need to provide additional support to those inner tubes.

Figure 9:
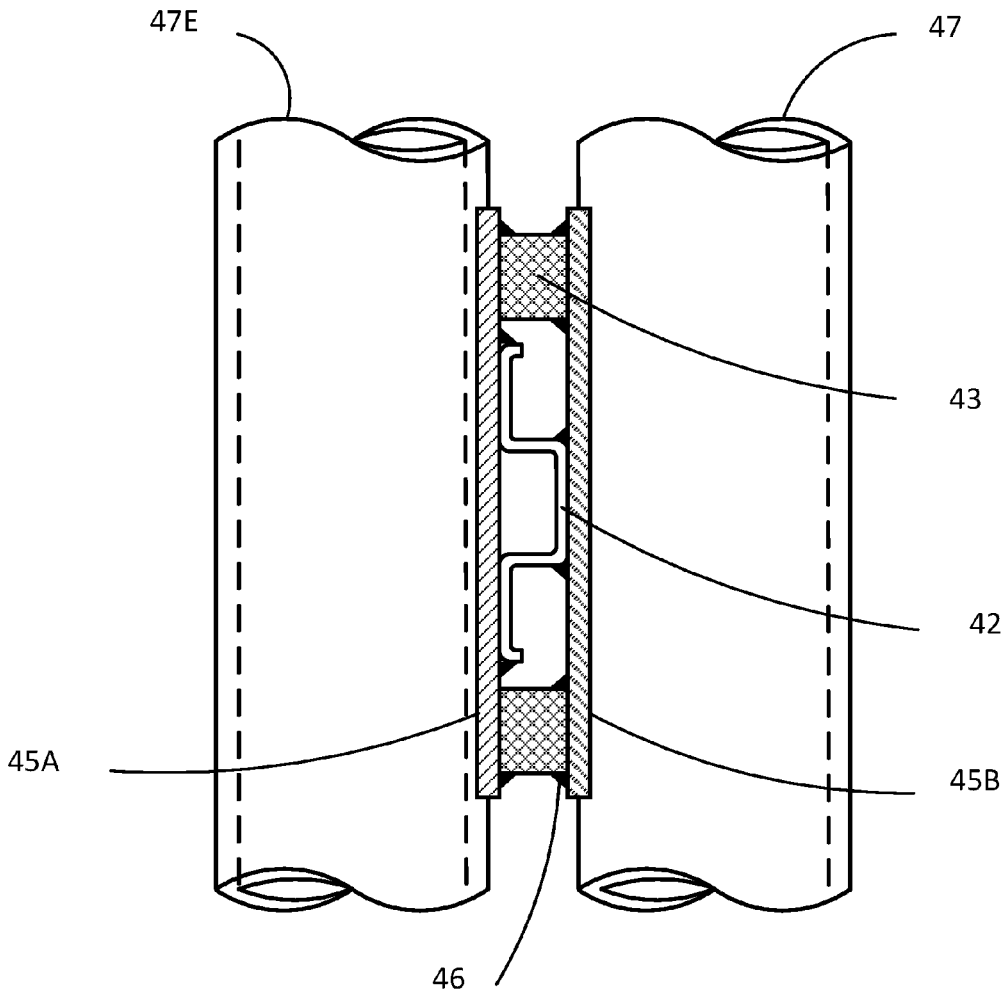
FIG. 9 is an enlarged view of a section in the direction of the arrows X-X of FIG. 8.

FIG. 9 shows the detailed cross-section of stake 40 along section X-X shown in FIG. 8. This sectional view shows protrusions 44B and 45B that are wider than the stake 40 to provide enhanced tube support in the especially vulnerable U-bend region. For improved strength, metal pieces 43 may be welded to both protrusions 44B and 45B via welds 46.

Figure 10:
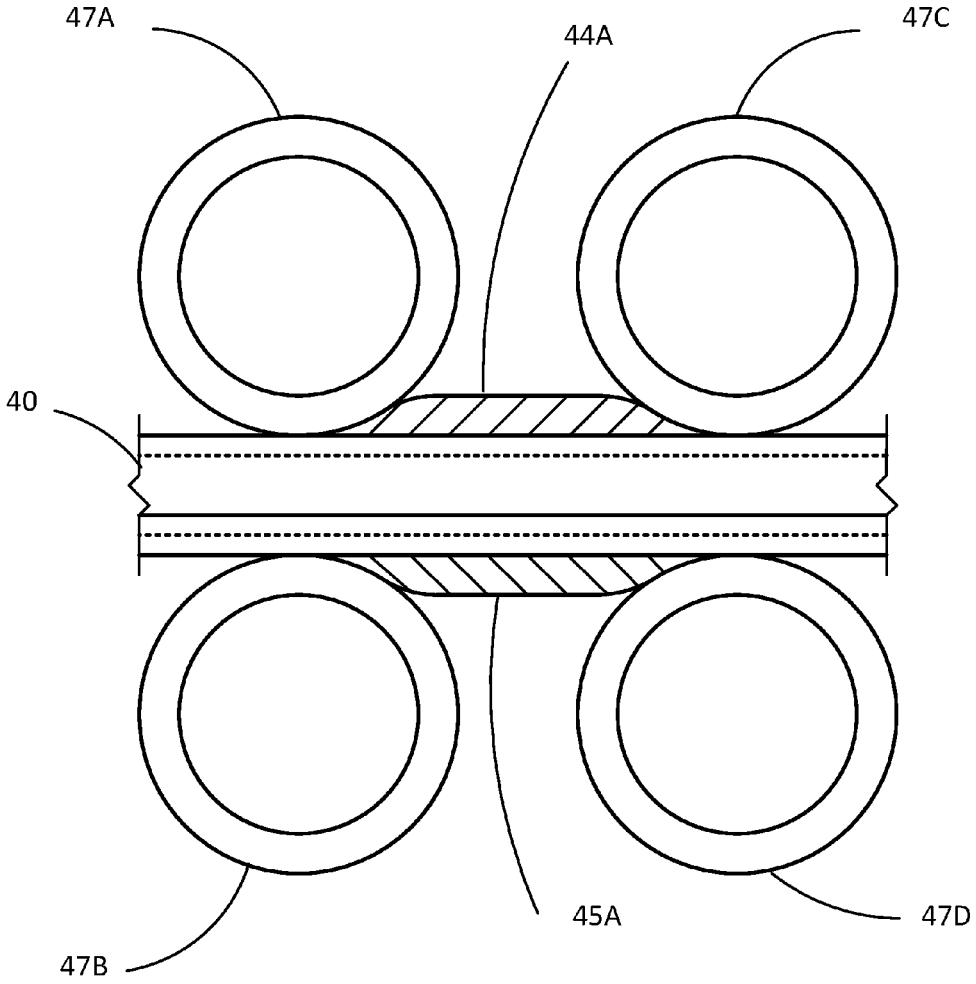
FIG. 10 is an enlarged view of section in direction of the arrows Y-Y of FIG. 8.

FIG. 10 shows the plan view of FIG. 8 along section Y-Y to reveal details of protrusions 44A and 45A.

Figure 11:
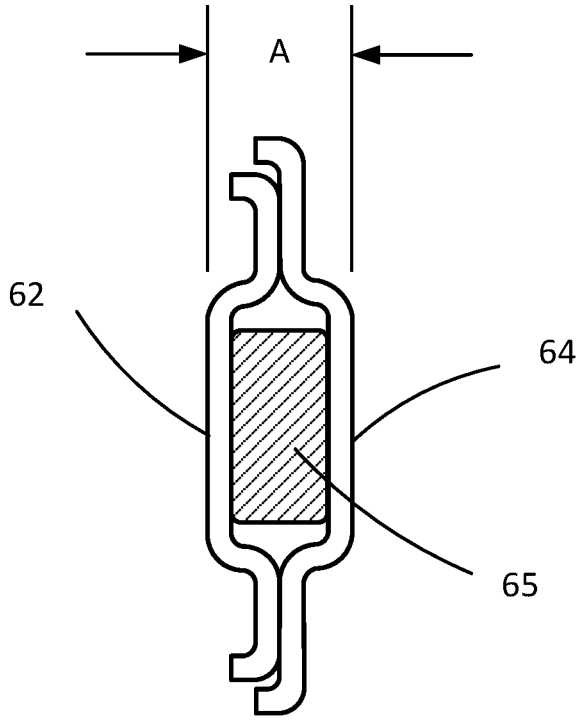
FIG. 11 is a cross-sectional view similar to FIG. 4 but for a stake made of two strips.

FIG. 11 shows the cross-section of stake made of two separate strips 62 and 64. These two strips 62 and 64 nest to yield a total thickness of "A" that is greater than the width of the tube lane to account for the clearance between the tubes and the holes in the baffles and that for slight warping of tubes. On rare cases where this "A" value does not provide adequate tube support, an oversized metal strip 65 may be inserted between strips 62 and 64 to achieve the desired goal.

Figure 12:
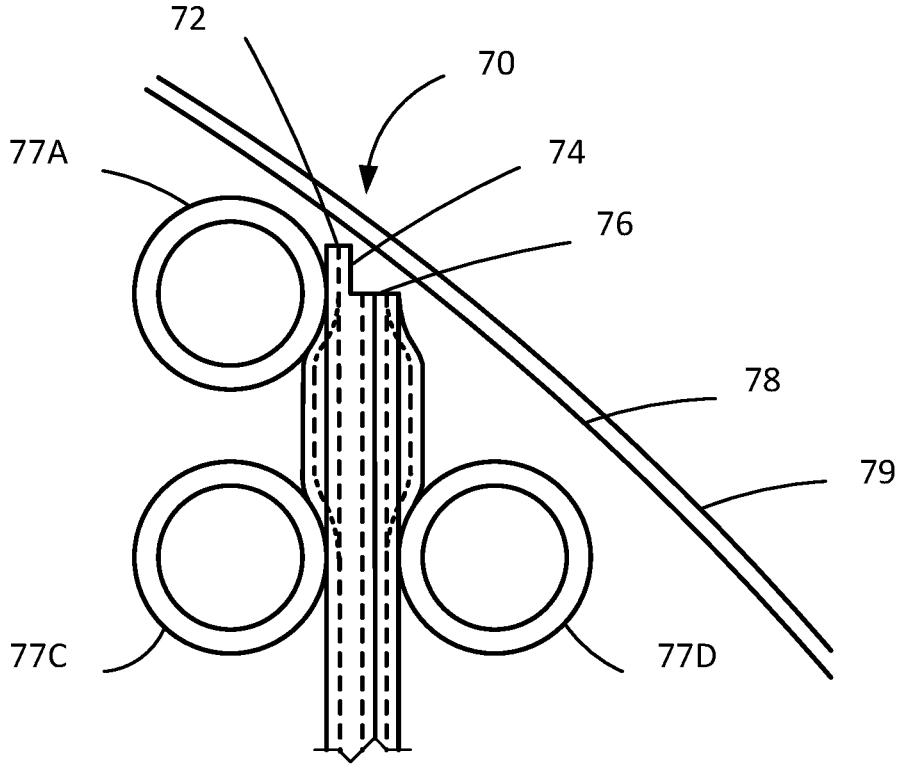
FIG. 12 is an end view of several tubes in a U-tube bundle with tubes being located very close to the edge of baffle and with a modified stake supporting the tubes.

FIG. 12 shows several tubes 77 that are located very close to the edge of a baffle 78 in a U-tube bundle. The inner surface of the shell 79 is also shown. The clearance between tube 77A and baffle 78 can be as small as 3 mm and the inner surface of the shell 79 can be only another 3 mm away. As a result, the stake 10 shown in FIG. 1 would interfere with the inner surface of the shell 79. To avoid such interference, the stake 70 may be trimmed off along lines 72, 74 and 76. Preferably, the material for the stakes 10, 20, 40 and 70 may be selected as the same material as that of the tubes in the tube bundle. However, an alternate metallurgy may be used based on the recommendation of a materials expert.

According to the present invention, a tube support device or a tube stake ("stake"), which is useful in mitigating flow-induced vibration in tube bundles, comprises an elongated member of a strip or a pair of elongated members that are nested together, which is intended to be inserted in a tube lane between the tubes of a tube bundle in a heat exchanger or other similar equipment. The stake is fabricated by deforming or folding of a thin strip of metal in a manner each will provide one or two flat surfaces to come in contact with the tubes flanking the tube lane in which the stake is inserted. The overall thickness of the stake (a single strip or a pair of nested strips) is greater than the gap between tubes (i.e., the tube lane width) so that the insertion of the stake would result in a displacement of each tube in a direction orthogonal to the flat surfaces of the stake. Such displacements of the tubes provide stiffening and superior support to these tubes.

The stakes may be used in all tube configurations. Preferably, the 90- and 45-degree (also referred to as the rectangular and rotated rectangular tube arrangements, respectively) tube layouts shall use a stake consisting of a pair of nested strips even though a single-strip design is also viable. On the other hand, the 30- and 60-degree (also referred to as the triangular and rotated triangular tube arrangements, respectively) layouts shall use the single-strip design.

The present invention also provides a robust design for vibration mitigation in the U-bend region of tube bundles made of U-tubes as well. This design may also be used in new bundles as a low-cost and superior design alternative to the technologies used currently in the marketplace.

The stakes described in this invention may be fabricated by conventional pressing with a set of dies. Preferably, a pair of rollers may be used to conveniently form each strip so that simple equipment may be used with a minimum force necessary to carry out the needed forming action.

The present invention allows alleviation of most of the problems inherent in the technologies available on the marketplace. Namely, since the stake can be formed by primarily bending or folding and also uses a reduced pressing depth, cracking of the strip material can be avoided. The stakes are provided with special designs on the outer end to enable robust locking on to up to six tubes so that pivoting of the stake is virtually impossible. The stakes can be easily trimmed at the end so that they will not interfere with the shell inner surface when U-tube bundles are involved.

While the present invention has been described with respect to preferred embodiments thereof, it will be apparent to those of skill in this art that certain alterations and modifications of those embodiments without departing from the spirit of my invention, which is to be limited only to scope, including equivalents, of the following, appended claims.

I claim:

1. A tube bundle having internal support means to mitigate flow-induced vibration, comprising a tube bundle formed from a plurality of longitudinally extending, elongated tubes arranged in rows with tube lanes extending substantially perpendicularly to said rows and separating adjacent rows of tubes, and a tube stake having opposed, substantially planar surfaces inserted in one of said lanes, the tube stake having a substantially uniform thickness formed from a strip of material, each of the substantially planar surfaces defining a parallel reference plane along a length of the tube stake, the tube stake comprising one or more protrusions formed or pressed into said strip, said one or more protrusions extending from either parallel reference plane, said one or more protrusions defining a first side that begins to deviate from the reference plane from which it extends at a first angle, the first side rising to a top end at a distal point from said parallel reference plane, the top end connecting to a second side that begins to extend back to said reference plane at an opposite angle from the first angle, said tube stake at the base of the one or more protrusions being thicker than the width of said lane, said one or more protrusions structured so that a first tube is located at said first side of said protrusion and a second, next adjacent tube is located at said second side of said protrusion, said protrusion being sized so that, in tube contacting position, said protrusion exerts a force on said tubes including a component substantially parallel to the reference plane from which it extends, said first tube being contacted by said first side of said protrusion and being moved in a direction away from said second tube by said first side, and said second tube being contacted by said second side of said protrusion and being moved in a direction away from said first tube by said second side, said first and second tubes thereby being stressed by said stake to add to their rigidity and reduce the vibration of said tubes during the flow of fluid thereacross.

2. A tube bundle as claimed in claim 1, in which there are a plurality of said protrusions spaced from each other along one of said planar surfaces of said tube stake.

3. A tube bundle as claimed in claim 1, in which there is at least one of said protrusions mounted on each of said opposed, substantially planar surfaces of said tube stake.

* * * * *